United States Patent [19]

Munsey

[11] Patent Number: 5,050,326

[45] Date of Patent: Sep. 24, 1991

[54] MODULAR DISPLAY REPLICA

[76] Inventor: Ronald L. Munsey, 3218 Hunterwood, Missouri City, Tex. 77459

[21] Appl. No.: 258,804

[22] Filed: Oct. 17, 1988

[51] Int. Cl.[5] ..... G09F 1/08

[52] U.S. Cl. ..... 40/538; 40/508; 40/657

[58] Field of Search ..... 40/1, 306, 637, 657, 40/427, 538, 539, 508

[56] References Cited

U.S. PATENT DOCUMENTS

| | | | |
|---|---|---|---|
| Re. 20,599 | 12/1937 | Shaw | 40/538 |
| 643,124 | 2/1900 | Gresh | 40/538 |
| 1,471,365 | 10/1923 | Sommers | 40/538 |
| 1,493,679 | 5/1924 | Kielar | 40/538 |
| 2,123,680 | 7/1938 | Whitehead | 40/538 |
| 2,148,676 | 2/1939 | Barnett | 40/538 X |
| 2,237,879 | 4/1941 | Hinkel | 40/538 |
| 3,949,502 | 4/1976 | Carr | 40/538 |

*Primary Examiner*—Laurie K. Cranmer

[57] ABSTRACT

A modular mass display replica of a selected prepackaged product is disclosed that includes a plurality of vertically stackable display sections, each section having a four-sided prism configuration and a predetermined height, depth and width functionally related to a preselected number of the packaged products to be displayed in each of the display sections. Each of the sections is rigidly formed of a preselected plastic material, the outer vertical surfaces of each of the sections replicating the typical external visual trade dress of the preselected pre-packaged product for visually portraying or replicating the preselected number of products stacked in contacting relationship based upon the predetermined height, depth and width functionally related to the preselected number of the products to be displayed. The display sections may be attached to each other to permit removable vertical stacking of each of the sections and prohibit relative horizontal movement between adjacent ones of the sections.

3 Claims, 2 Drawing Sheets

MODULAR DISPLAY REPLICA

BACKGROUND OF THE INVENTION

This invention relates to display replicas for building product displays for selected pre-packaged products, and more specifically relates to a modular mass display replica for pre-packaged products such as soft drinks and other canned goods.

In building display replicas in grocery stores for pre-packaged food items such as canned goods, soft drinks and the like, it is time consuming to build and take down a large display of the product. Typically the prepackaged product, whether it be cans or packages, must be removed from the cartons or cases and a large product display built at the end of a product shelf island or against a wall in the store. Many of the large supermarkets and other grocery outlets utilize such large displays to attract attention to the product for "impulse" and "spur of the moment" purchases. To build a large display, for example, of soft drink cans, the display may include over 200 cases of the product, (approximately 5,000 cans) and can take several hours to construct and to remove when the sale is over.

The prior art has disclosed many means of providing cardboard and other types of printed replicas, usually two-dimensional, that can approximate what the prepackaged product may look like. However, none of the prior art displays can duplicate a large scale mass display of a selected pre-packaged product. One of the primary functions of the present invention is to provide an exact replica or representation on display of a likeness of the product being sold. The instant invention provides a modular mass display replica for selected pre-packaged products that is convincingly exact in its appearance regarding the visual trade dress of the packaged product. Accordingly, it will be a convincing exact replica of the sale merchandise. In addition, the display replica must be light weight and of such size and dimensions that it will be easy to assemble and disassemble, and will be readily storable when not in use. In most situations, the display replica will constitute the back wall or backdrop of the display, thus becoming an actual part of and used in the display itself. However, actual products would be displayed from a front position in conjunction with the replica display for purchasers to select and take products for purchase.

Accordingly, one primary feature of the present invention is to provide a display replica that is modular and easy to vertically stack for assembling and disassembling the display.

Yet another feature of the present invention is to provide a display replica that is light weight and easy to transport and store.

Still another feature of the present invention is to provide a display replica that will save hours of labor in setting up and dismantling a pre-packaged product display.

BRIEF SUMMARY OF THE INVENTION

The present invention remedies the problems of the prior art by providing a modular mass display replica of a selected pre-packaged product that comprises a plurality of vertically stackable display sections, each section having a four-sided prism configuration and a predetermined height, depth and width functionally related to a preselected number of the packaged products to be displayed in each of the display sections. Each of the sections is rigidly formed of a preselected plastic resin material, the outer vertical surfaces of each of the sections replicating the typical external visual trade dress of the preselected pre-packaged product. The display section visually portrays or replicates the . preselected number of products stacked in contacting relationship based upon the predetermined height, depth and width functionally related to the preselected number of the products to be displayed.

A means of attachment is provided that cooperates with each of the display sections and permits removable vertical stacking of each of the sections and prohibits relative horizontal movement between adjacent ones of the vertical stackable display sections. The stacking means may take the form of one of several embodiments. One embodiment of the stacking means may include upper and lower surfaces disposed on each of the display sections that will accept and nest with a registering horizontal surface of a vertically disposed adjacent display section for aiding in vertical stacking of the display sections. In addition, a plurality of connecting members are each adapted for partial insertion into opposed registering bores disposed in the vertically adjacent display sections for preventing relative horizontal movement between the vertically adjacent stacked display sections.

In another embodiment, the stacking means comprises a plurality of spaced bores disposed vertically in lower horizontally disposed portions of each of the display sections, and a plurality of spaced connecting members vertically projecting from the upper horizontally disposed portions of each of the display sections in registering alignment with the plurality of spaced bores for mating therewith and permitting vertical stacking of the display sections but preventing relative horizontal movement therebetween.

BRIEF DESCRIPTION OF THE DRAWINGS

In order that the manner in which the above-recited advantages and features of the invention are obtained and can be understood in detail, a more particular description of the invention may be had by reference to specific embodiments thereof which are illustrated in the accompanying drawings, which drawings form a part of this specification.

In the drawings.

DETAILED DESCRIPTION OF THE PREFERRED EMBODIMENTS

Figure 1:
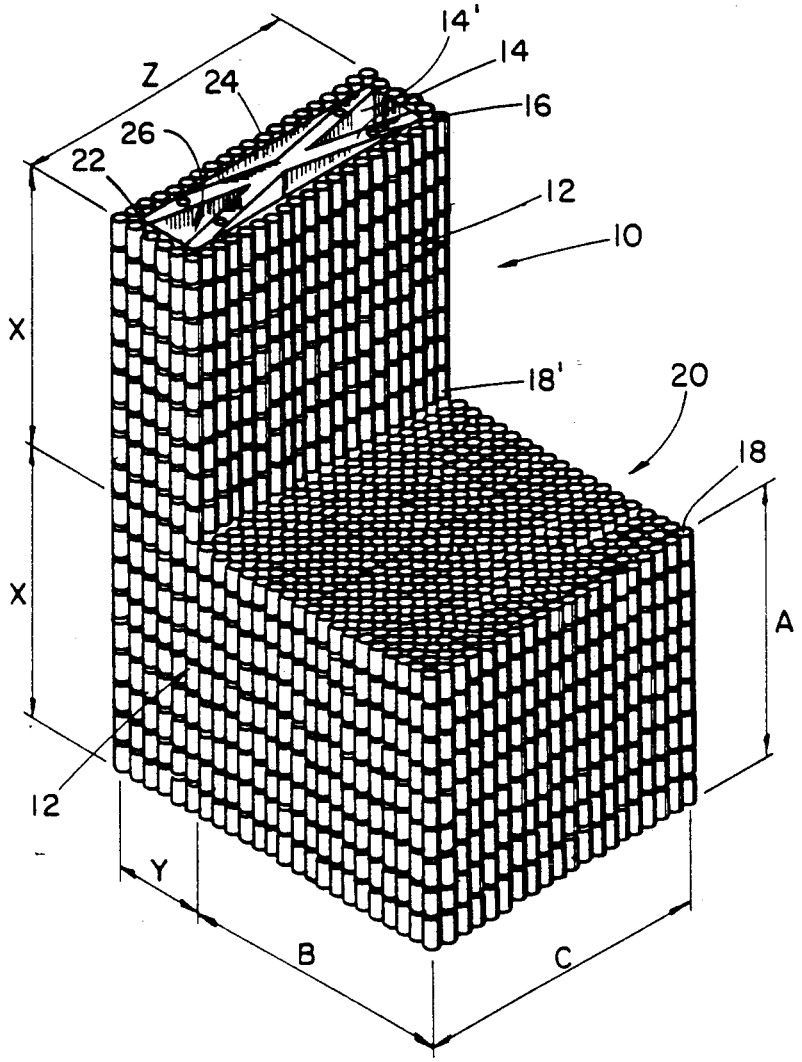
FIG. 1 is an isometric view of the display replica in accordance with this invention used in connection with a display utilizing the actual packaged product.

Referring now to FIG. 1, an isometric view of the display replica 10 is shown. The product display comprises a plurality of vertically stackable display sections 12, and a quantity of actual prepackaged product 20. The plurality of display replica sections 12 forms a back wall or backdrop for the product display while customers may obtain the product by selecting individual packaged products 18 from the forward stacked quantity of products 20. Each of the display replicas 12 has a four-sided prism configuration having a predetermined height (X), depth (Y) and width (Z) functionally related to a preselected number of the prepackaged products 18' to be displayed in each of the display sections 12.

Each of the display sections 12 is rigidly formed of a preselected plastic resin material such as Polyethyleneterephthalate or Polypropylene. Of course, any other suitable plastic resin material may be used if it contributes to the rigidity, weight and durability characteristics herein described. The outer vertical surfaces of the display replica sections 12 replicate the typical external visual trade dress of the preselected number of the prepackaged products 18' that are stacked in adjacent contacting relationship based on the predetermined height (X), depth (Y) and width (Z) above described. The height (X), depth (Y) and width (Z) are functionally related to the preselected number of the prepackaged products to be displayed in each of the display replica sections 12.

The display replica section 12 comprises a molded four-sided construction having a generally "hollow" inner space bounded on the short sides by wall 22 and on the long sides by wall 24. Braces 14 and 14' are disposed interiorly of the walls 22 and 24 to provide support and rigidity to the section 12, and provide interior openings 26. A plurality of bores 16 are provided in the horizontal surfaces of the cross-braces 14 and 14' (both upper and lower horizontal portions or surfaces of the section 12) for purposes to be hereinafter described in greater detail.

As shown in FIG. 1, a typical mass display of the preselected number of prepackaged products, say soft drink cans, for instance, comprise the backdrop section having a volume represented by the two vertically-stacked replica sections 12, having a combined height of 2X, a depth of Y and a width of Z. Similarly, the front portion 20 of the display, where customers are expected to select and actually pick up the product, can typically have a volume represented by the height (A), the depth (B) and the width (C) as shown in FIG. 1. For many typical mass displays of products, such as soft drinks for instance, the rule of thumb is for the volume of the product selection stack 20 to have a ratio to the volume of the backdrop stack !0 of approximately 3:2. Accordingly, if the prepackaged product is a soft drink packaged in an aluminum can, then the backdrop portion 10 typically may have the following dimensions:

height (X)=9 stacked cases
depth (Y)=1 case
width (Z)=5 side-by-side cases
where: a case=a 6×4 configuration of cans=24 cans Therefore, the total backdrop (or back wall) 10 of the display can typically include 90 cases of individually stacked cans equivalent to 2160 cans.

In accordance with the desirable 3:2 ratio above described, the front product selection portion 20 of the mass display would include 135 cases of individual stacked cans equivalent to 3240 cans, since the portion 20 would have the following dimensions:

height (A)=X=9 stacked cases
depth (B)=3Y=3 cases
width (C)=Z=5 side-by-side cases
where: a case=a 6×4 configuration of cans=24 cans The total of 5400 individual stacked cans can often take an individual 3 to 4 hours to construct and nearly that length of time to disassemble. Accordingly, it may be seen that if the backdrop or back wall 10 of individually stacked cans can be replaced by the above described modular display replica sections 12, the time for assembling the mass display of product can be nearly halved, thus saving a significant amount of employee labor and enabling an employee to set up a much greater number of such displays in a given amount of time.

Figure 2:
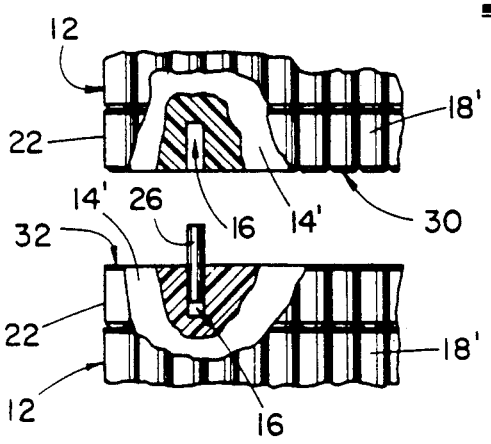
FIG. 2 is a fragmentary detailed view of a pair of vertically stackable display replicas in accordance with the invention as shown in FIG. 1, illustrating one embodiment of the stacking means.

Referring now to FIG. 2, one embodiment of the stacking means for permitting vertical "stacking" of the display replica sections 12 and preventing relative horizontal movement between adjacent vertical sections 12 is shown. A pair of display replica sections 12 are shown, one disposed vertically above the other. The upper and lower horizontal portions 32 and 30, respectively, of each section 12 have vertically disposed bores 16 in the cross-braces 14 and 14' (see FIG. 1). When the display replica sections 12 are oriented for vertical stacking, the bores 16 in the respective upper and lower horizontally disposed portions 14 and 14' are placed in an opposing registering relationship. A connector member 26, sized for insertion into the bores 16 is inserted into the opposed registering bores 16 when the display replica sections 12 are vertically stacked to hold the sections in a vertical stacked alignment and to prevent relative horizontal movement between the adjacent stacked sections. This prevents the sections 12 from being knocked over if accidentally or inadvertently struck.

Figure 3:
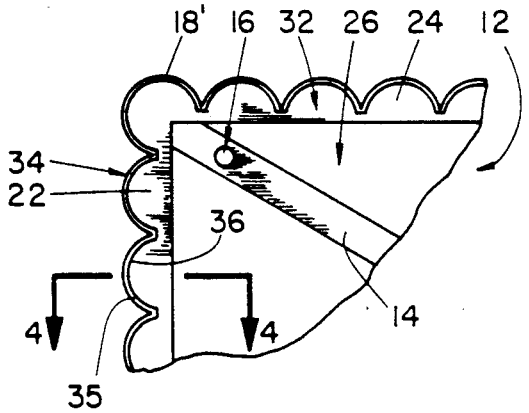
FIG. 3 is a fragmentary top view of a single display replica as shown in FIG. 1.
Figure 4:
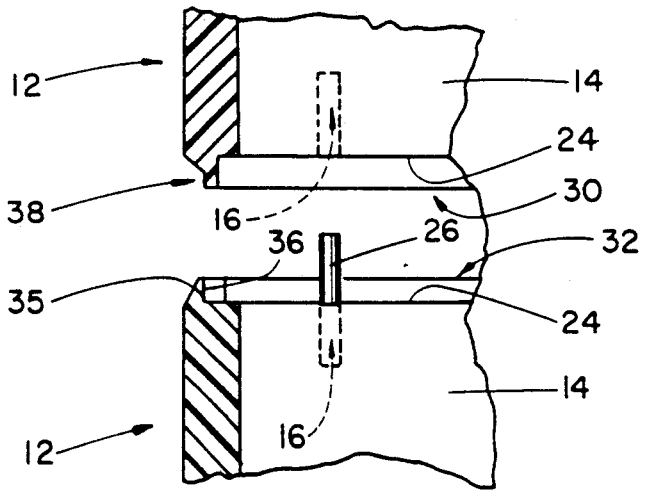
FIG. 4 is a fragmentary vertical cross-sectional view of vertically display replicas taken along line 4—4 of FIG. 3 and showing another embodiment of the stacking means.

FIGS. 3 and 4 disclose another embodiment of the stacking means for the display replica sections 12 as shown in FIG. 1. In FIG. 3, a fragmentary top view of the section 12 is shown. The side and end walls, 24 and 22, respectively, are shown with the outer replica surfaces 18' for the packaged product, here shown as a curved portion 34 representing a soft drink can. The edge 35 of the can replica forms an upstanding edge with an internal shoulder 36 in the upper horizontal surface 32 or portion of the display section 12. The lower horizontal portion 30 of a display section 12 has a projecting mating curved surface 38 sized for insertion within the edge 35 and contacting shoulder 36 of the lower section 12. This "nesting" feature provides positive vertical stacking and assists in preventing relative horizontal movement between the adjacent sections. In addition, opposed registering bores 16 may be provided in the sections 12 for accepting a connecting member 26 for positive prohibition of relative horizontal movement between the sections 12 as hereinabove described with respect to FIG. 2.

Figure 5:
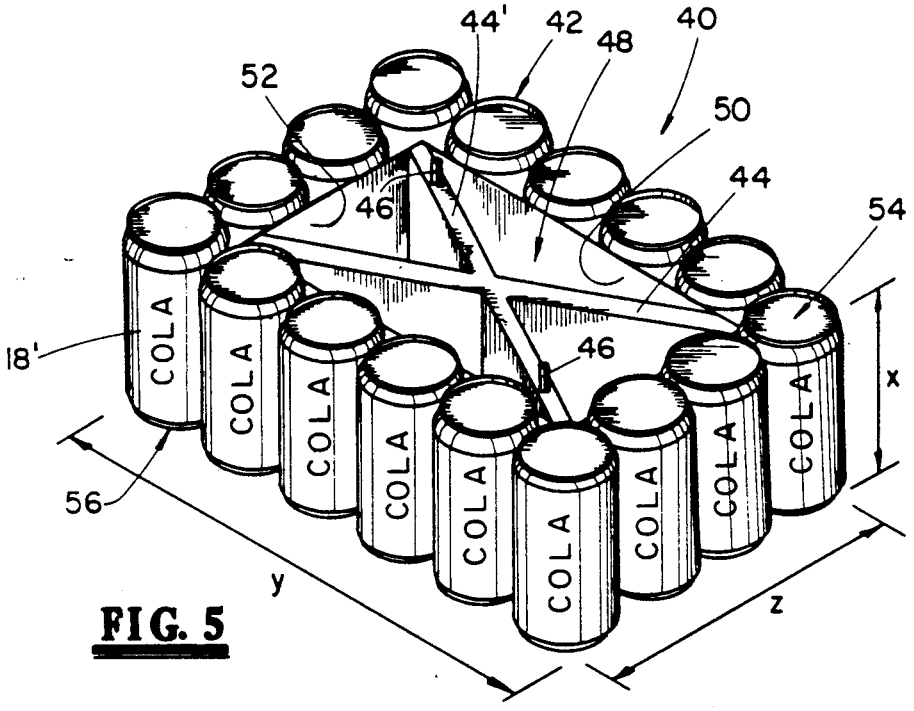
FIG. 5 is an isometric view of another embodiment of the display replica in accordance with this invention.
Figure 6:
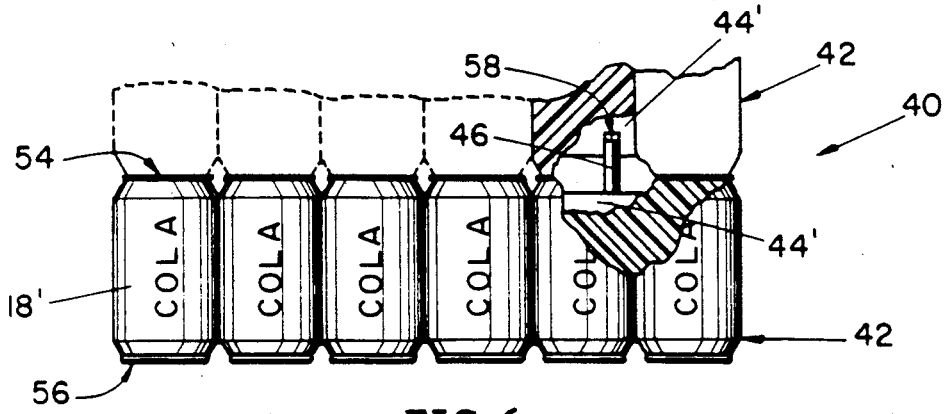
FIG. 6 is a side view, partly in fragmentary cross-section, showing the embodiment of the display replica illustrated in FIG. 5 vertically stacked and utilizing a third embodiment of the stacking means.

Referring now to FIGS. 5 and 6, another embodiment of the display replica 40 is shown. The display replica 40 may comprise individual replica sections 42 that have a basically four-sided prism configuration with a generally hollow interior. The display section 42 has a predetermined height (x), depth (y) and width (z) functionally related to a preselected number of the prepackaged products to be displayed in each section. In the embodiment shown in FIGS. 5 and 6, the number of prepackaged products in a section 42 is shown as a single case of soft drinks, for example, having a height (x) equal to a single can, a depth (y) equal to six cans and a width (z) equal to four cans. Such a smaller display section will permit the building of smaller displays and provide greater flexibility in building a mass display than the large display replica sections 12 shown in FIG. 1.

The display section 42 is rigidly formed of a preselected plastic resin material and has side and end walls 50 and 52, respectively, with structural cross-braces 44 and 44', having open spaces 48 therebetween. Integrally formed in the upper surfaces of each of the cross-braces 44 and 44' are vertically projecting members 46. The projecting members 46 register with vertical bores 58 (see FIG. 6) disposed in the lower horizontal surfaces of braces 44 and 44' to accept the projecting members 46 as will hereinafter be further described.

The sides 50 and 52 provide a plurality of the selected prepackaged products 18' arranged in adjacent contacting relationship. In the example shown, the prepackaged product is a soft drink can 18' and the outer vertical surfaces thereof replicate the typical external visual trade dress of the prepackaged product. The outer vertical surfaces of the product 18' visually replicate the preselected number of the prepackaged products stacked in adjacent contacting relationship based on the predetermined heights, depth and width functionally related to the preselected number of products to be displayed. In the embodiment 42 shown in FIGS. 5 and 6, the products 18' are shown formed in their entirety to replicate a complete top and lower surface of each product 18' formed in the section 42. Each of the product packages 18' (for example, a soft drink can) has a recessed top 54 and a projecting lower edge 56 sized to register and nest with vertically adjacent opposing lower edges 56 and/or tops 54 when the sections are vertically stacked as shown in FIG. 6.

This "nesting" feature aids in the vertical stacking and alignment of the sections 42, and the insertion of projecting fingers or members 46 into registering bores 58 (see FIG. 6) prevents relative lateral or horizontal movement between the stacked sections 42. Of course, other stacking means for accomplishing the vertical alignment and preventing relative lateral/horizontal movement of the adjacent sections 42 (or 12) may be utilized. If the prepackaged product does not have a typical design "nesting" feature like soft drink cans, then the nesting feature as shown in FIGS. 3 and 4 may be utilized, or no nesting feature is necessary as shown in FIG. 2. The combination bore 16/connector member 26 (FIG. 2) or bore 58/projecting member 46 (FIG. 6) may function as a stacking means that functions to provide both the functions of permitting vertical stacking and preventing relative horizontal movement between adjacent ones of the vertically stacked display sections 12 or 42.

Numerous variations and modifications may be made in the structure herein described without departing from the present invention. Accordingly, it should be clearly understood that the forms of the invention herein described and shown in the figures of the accompanying drawings are illustrative only and are not intended to limit the scope of the invention.

I claim:

1. A modular mass display replica of a selected prepackaged product, comprising a plurality of vertically stackable display sections, each section having a four-sided prism configuration having a predetermined height, depth and width functionally related to a preselected number of a plurality of the prepackaged products to be displayed in each of said display sections, each of said sections being rigidly formed of a preselected plastic resin material, the outer vertical surfaces of each of said display sections replicating the typical external visual trade dress of said preselected number of a plurality of the prepackaged products stacked in adjacent contacting relationship based on said predetermined height, depth and width functionally related to said preselected number of the prepackaged products to be displayed in each of said display sections, and stacking means cooperating with each of said display sections for permitting removable vertical stacking of each of said display sections and prohibiting relative horizontal movement between adjacent ones of said vertically stackable display sections, wherein said stacking means further includes upper and lower surfaces disposed on each of said display sections that will accept and will nest with a registering horizontal surface of a vertically disposed adjacent display section for aiding in vertical stacking of said display sections, a plurality of laterally-spaced bores disposed vertically in the upper and lower horizontally-disposed portions of each of said display sections in an opposed registering relationship when said display sections are vertically stacked, and a plurality of connecting rod members each adapted for partial insertion into each of said opposed registering bores of said vertically adjacent display sections for preventing relative horizontal movement between said vertically adjacent stacked display sections.

2. The modular display replica as described in claim 1, wherein the selected prepackaged product comprises a soft drink packaged in a generally cylindrical aluminum can, and wherein each of said plurality of vertically stackable display sections replicates a preselected number of said cans of the soft drink to form a display section having a predetermined height, depth and width.

3. The modular display replica as described in claim 2, wherein said preselected number of cans of the soft drink replicated in each display section is twenty-four, and said predetermined height of said display section is one can, said predetermined depth of said display section is six cases and the predetermined width of said display section is four cases.

* * * * *